United States Patent [19]

Stunger

[11] 3,965,575

[45] June 29, 1976

[54] KNIFE BLADE SUPPORT UNIT

[75] Inventor: Edward R. Stunger, Greenville, S.C.

[73] Assignee: Bigelow-Sanford, Inc., Greenville, S.C.

[22] Filed: Apr. 21, 1975

[21] Appl. No.: 569,784

Related U.S. Application Data

[63] Continuation-in-part of Ser. No. 498,253, Aug. 19, 1974, abandoned.

[52] U.S. Cl. ..... 30/294; 30/317; 30/330; 30/334; 30/335

[51] Int. Cl.[2] ..... B26B 1/08; B26B 3/08

[58] Field of Search ..... 30/334, 332, 333, 330, 30/336, 320

[56] References Cited

UNITED STATES PATENTS

| | | | |
|---|---|---|---|
| 1,567,943 | 12/1925 | Grush | 30/335 |
| 1,667,867 | 5/1928 | Mosley | 30/330 |
| 2,215,216 | 9/1940 | Gits et al. | 30/162 X |
| 2,521,291 | 9/1950 | Green | 30/334 |
| 2,601,523 | 6/1952 | Hill | 30/330 |
| 3,058,215 | 10/1962 | Williams | 30/317 |
| 3,478,427 | 11/1969 | Tims | 30/294 X |
| 3,488,843 | 1/1970 | Tims | 30/162 |

FOREIGN PATENTS OR APPLICATIONS

| | | | |
|---|---|---|---|
| 12,061 | 4/1880 | Germany | 30/335 |

*Primary Examiner*—Al Lawrence Smith
*Assistant Examiner*—J. T. Zatarga

[57] ABSTRACT

Blade support unit, for receiving a replaceable blade, includes a blade receiving slot defined by a rigid base member and a second flexible member, the members having blade engaging surfaces and being maintained with fixed separation equal to the blade thickness along a first edge of the slot. A clamping member passes through extensions of the members beyond the slot boundaries, and an elongated tightening lever engages the clamping member so that force applied to the lever is transferred through the clamping member to clamp the blade between the two members.

5 Claims, 3 Drawing Figures

KNIFE BLADE SUPPORT UNIT

CROSS REFERENCE TO RELATED APPLICATION

This is a continuation-in-part of U.S. patent application Ser. No. 498,253, filed Aug. 19, 1974, for "Knife Blade Support Unit", now abandoned.

BACKGROUND OF THE INVENTION

This invention relates to implements used to cut heavy sheet or web materials (e.g., floor coverings, plastic, leather, etc.).

While a variety of arrangements to support and clamp such replaceable blades have been proposed, each has involved one or more of various drawbacks, especially when used to cut relatively heavy materials. Thus, for example, those employing a screw or bolt to hold the blade against a support surface have often necessitated the use of a tool (e.g., a wrench or screwdriver) thus resulting in a cumbersome and time-consuming operation and, additionally, frequently resulting in the stripping of threads thus requiring replacement of parts or discarding of the knife. Other approaches have involved the use of a knurled or wing nut to permit manual tightening. These designs have frequently made it impossible to apply sufficient force to securely clamp the blade, have included nut portions projecting from the knife in various directions making use of the knife difficult in various circumstances, and require considerable manual dexterity in attempting to simultaneously tighten the nut (requiring the full use of one hand) while holding the support unit and positioning the still-loose blade thereon. Additionally, the flexibility of the blade-contacting members, while facilitating blade insertion and removal, has resulted in inadequate blade support in the cutting of heavy materials (e.g., carpet).

SUMMARY OF THE INVENTION

It is a principal object of the present invention to provide an improved blade support unit which is easy to manipulate, which holds a blade securely, and which does not require a special tool to adequately secure the blade in the unit. It is an additional object of the present invention to provide such a support unit which is extremely durable and maintenance free and which is simple and inexpensive to manufacture.

A blade support unit constructed according to the present invention includes a blade receiving slot defined by a rigid base member and a second flexible member, the members having blade engaging surfaces which are maintained with a fixed separation equal to the blade thickness along a first edge of the slot. A clamping member passes through extensions of those two members at a location which is spaced apart from the aforementioned first slot edge. An elongated tightening lever is provided for the clamping member and lies in a plane generally parallel to the slot, whereby force applied to the lever is transferred through the clamping member to urge together the slot-defining surfaces thereby securing the blade therebetween. In preferred embodiments, the clamping member comprises a carriage bolt and the lever includes a threaded opening engageable with that bolt; the base member is thicker than either the slot or the second member; and the second member is partially received in a recess of the base member, whereby the rigidity of the base member protects the second member.

BRIEF DESCRIPTION OF THE DRAWING

Other objects, features and advantages of the invention will be apparent from the description and drawings herein of particular preferred embodiments thereof, in the drawing.

DESCRIPTION OF PARTICULAR PREFERRED EMBODIMENTS

Figure 1:
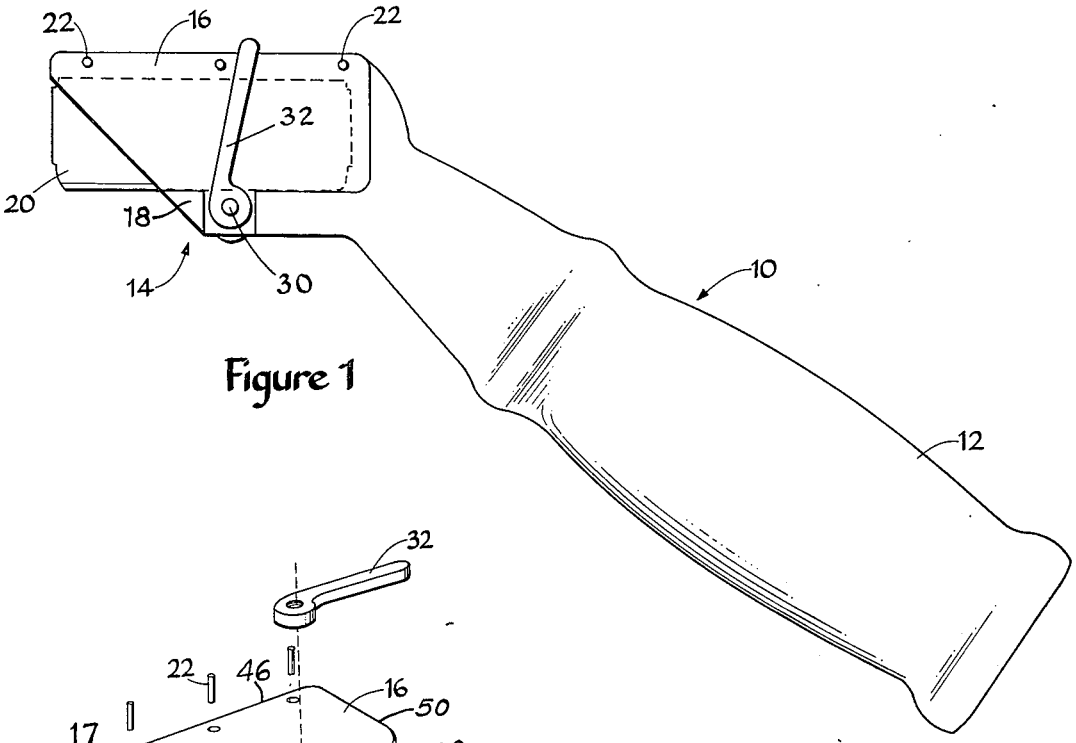
FIG. 1 is a side elevation of a knife embodying the invention with a replaceable blade in place on the knife.

Referring generally to the drawings, knife 10, shaped in cast aluminum, generally comprises handle 12 and blade support unit 14, which retains a standard blade 20 of generally rectangular outline. Blade support unit 14 includes rigid base member 18 integral with handle 12, and a resilient metal member 16, made for example of steel, which is secured to base member 18.

Base member 18 is formed to provide means for maintaining flexible member 16 in blade-retaining position. When member 16 is in such position, as seen in FIG. 1, members 16 and 18 together define a blade receiving slot.

Base member 18 provides a flat inner blade-engaging surface 19, bounded along two adjacent sides by raised lip portions 24 and 25. The raised lip portions have thickness substantially equal to the thickness of a standard blade 20 and provide separation and support means, as will be explained. Base member 18 further provides an upper surface 44, raised above lip portions 24 and 25, and forming an inner edge 42, set back from the edge of lip portion 25, and continuous with inner edge 43 opposed to lip portion 24. In addition, an alignment member is provided in base member 18, in the form of an open channel 26 having a flat bottom surface continuous with base inner surface 19, and extending through inner edge 43 to the exterior of base member 18. The forward edge 41 of base 18 is slanted as seen in the drawings.

Resilient member 16 is less than about one-half the thickness of base 18 through surface 44, and provides a generally flat inner blade-engaging surface 17, bounded by opposed parallel edges 46 and 48, which are joined by edge 50 and by slanted edge 52. Member 16 further includes tongue 26a extending beyond edge 48. A portion of the surface of tongue 26a is continuous with surface 17, and tongue 26a is alignable with channel 26.

Resilient member 16 is received within base 18 in such a manner that edge 50 of member 16 abuts inner edge 42 of base 18, and the portion of member 16 adjacent edge 50 overlies base lip portion 25. Further, the portion of member 16 adjacent edge 46 overlies base lip portion 24 and is secured thereto by rivets 22. Lip portions 24 and 25 maintain inner surface 17 of resilient member 16 separated from base inner surface 19, in the areas adjacent the lip portions, by a distance approximately equal to the thickness of blade 20. When member 16 is in this position, its edge 48 abuts base inner edge 43, and its tongue **26*a* is aligned with base channel 26 and lies therein. Slanted edge 52 of member 16 is parallel with slanted edge 41 of base 18**.

When flexible member 16 is retained in the described manner within base 18, the base inner surface 19 together with those portions of surface 17 that do not overlie lip portions 24 and 25 form the top and bottom surfaces of a blade receiving slot, defined between member 16 and base 18, and having an opening between base slanted edge 41 and slanted edge 52 of flexible member 16, to admit a blade 20.

Figure 2:
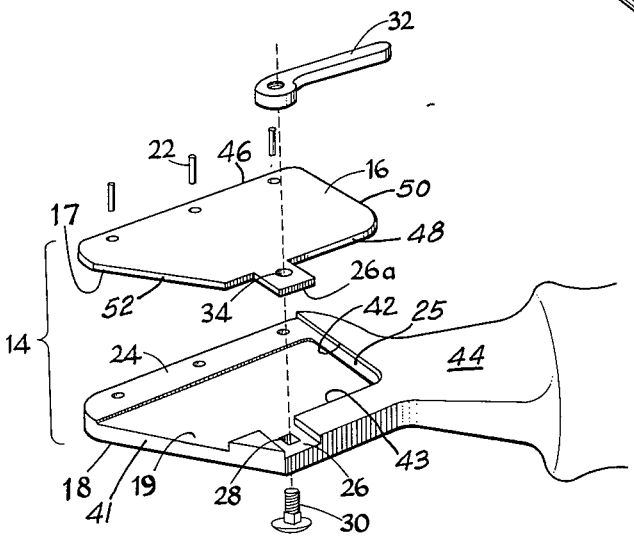
FIG. 2 is an exploded view of the blade support unit of the knife of FIG. 1 with the blade removed.
Figure 3:
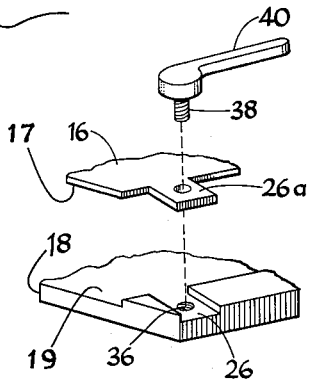
FIG. 3 is an exploded view illustrating a portion of a second embodiment constructed according to the present invention.

The aligned members, tongue 26*a* and channel 26, together serve as a tightening area. In one embodiment (FIG. 2), channel 26 has a square hole 28 therethrough for receiving the unthreaded square portion of a carriage bolt 30, which is thereby prevented from rotating. Elongated lever nut 32 is threaded to mate with a bolt 30 above its protrusion through circular hole 34 in aligned tongue 26*a*. In a second embodiment (FIG. 3), hole 36 in channel 26 is threaded to mate with the threaded portion 38 of elongated lever bolt 40.

In operation, when elongated lever 32 (or 40) is loosely threaded, a blade is entered into the blade-receiving slot, adjusted to the desired degree of protrusion, and elongated lever 32 (or 40) is rotated until the surfaces 17 and 19 frictionally contact the blade. The extended length of the lever enables the user to manually tighten the grip of the surfaces on the blade to a degree formerly possible only with the aid of a tool. To readjust or remove the blade, the lever is manually urged in the reverse direction thereby loosening the grip. As the lever projects in a single direction from the axis of part 30 (or 38), it will always be possible to have it lie adjacent the unit 14 (see FIG. 1) rather than having portions projecting (e.g., downwardly in FIG. 1) from the unit 14. The member 16 is somewhat flexible and is mounted on base 18 such that its portions remote from rivets 22 will slightly move away from surface 19 when the clamping force is released thereby facilitating convenient blade removal and replacement.

As will be understood by those skilled in the art, the separation of surfaces 17 and 19 adjacent lip portions 24 and 25 by a distance equal to the blade thickness assures firm contact of the entirety of surfaces 17 and 19 with the blade in the clamped configuration of FIG. 1. Additionally, the provision of lip portion 25 adjacent inner edge 42 serves to protect the less rigid member 16 against damage (e.g., distortion and partial loss of clamping contact with blade) by a blow sustained by the member 16 (e.g., if the knife 10 were accidently dropped).

What is claimed is:

1. A knife blade support unit for receiving a replaceable blade having a predetermined thickness comprising a blade-receiving slot defined by a rigid base member and a flexible second member, each said member having a blade engaging inner surface, said base member providing an open channel including a surface portion continuous with said base member inner surface and extending therefrom, said second member providing a tongue alignable with said base member channel and including a surface portion continuous with said second member inner surface and extending therefrom, means spaced from said channel and tongue maintaining said inner surfaces fixed along a first edge of said defined slot spaced from said channel and tongue with a predetermined separation substantially equal to said predetermined blade thickness, a clamping member passing through said channel and tongue, and an elongated tightening lever for said clamping member lying in a plane generally parallel to said defined slot and rotatable in said plane, whereby force applied to said lever is transferred through said clamping member to urge together said inner surfaces securing said blade therebetween.

2. The unit of claim 1 wherein said clamping member comprises a carriage bolt and said lever includes a threaded opening for receiving said carriage bolt.

3. The unit of claim 1 wherein said clamping member comprises a threaded member integral with said lever.

4. The unit of claim 1 wherein said rigid base member has a thickness, in a direction perpendicular to said surfaces, which is a plurality times thicker than the thickness of said slot.

5. The unit of claim 4 wherein said rigid base member thickness is a plurality times thicker than the corresponding dimension of said second member.

* * * * *